US005418509A

United States Patent [19]

Piirainen

[11] Patent Number: 5,418,509

[45] Date of Patent: May 23, 1995

[54] HIGH FREQUENCY COMB-LIKE FILTER

[75] Inventor: Risto Piirainen, Oulu, Finland

[73] Assignee: Nokia Telecommunications Oy, Espoo, Finland

[21] Appl. No.: 142,331

[22] PCT Filed: May 22, 1992

[86] PCT No.: PCT/FI92/00159

§ 371 Date: Nov. 16, 1993

§ 102(e) Date: Nov. 16, 1993

[87] PCT Pub. No.: WO92/21157

PCT Pub. Date: Nov. 26, 1992

[30] Foreign Application Priority Data

May 24, 1991 [FI] Finland ..... 912519

[51] Int. Cl.[6] ..... H01P 1/205

[52] U.S. Cl. ..... 333/203; 333/206

[58] Field of Search ..... 333/202, 203, 206, 207, 333/222

[56] References Cited

U.S. PATENT DOCUMENTS

| | | | |
|---|---|---|---|
| 4,143,344 | 3/1979 | Nishikawa et al. | 333/202 |
| 4,224,587 | 9/1980 | Makimoto et al. | 333/4,284,966 |
| 4,245,198 | 1/1981 | Nishikawa et al. | 333/206 X |
| 4,268,809 | 5/1981 | Makimoto et al. | 333/202 |
| 4,284,966 | 8/1981 | Wanat | 333/202 |
| 4,386,328 | 4/1983 | Masuda et al. | 333/202 |
| 4,523,162 | 6/1985 | Johnson | 333/202 |
| 5,023,579 | 6/1991 | Bentivenga et al. | 333/203 |

FOREIGN PATENT DOCUMENTS

| | | |
|---|---|---|
| 0176966 | 6/1988 | European Pat. Off. . |
| 2808369 | 9/1979 | Germany . |
| 2082398 | 3/1982 | United Kingdom . |
| 2105918 | 3/1983 | United Kingdom . |
| WO9211664 | 7/1992 | WIPO . |

OTHER PUBLICATIONS

Matthaei et al., "Microwave Filters, Impedance Matching Networks, and Coupling Structures", Artech House Books, Dedham, Mass., pp. 165–168. 1964.

Patent Abstracts of Japan, vol. 8; No. 229, E273, Abstract of JP 59–110201, publ. 1984–06–26.

*Primary Examiner*—Seungsook Ham

*Attorney, Agent, or Firm*—Cushman Darby & Cushman

[57] ABSTRACT

The invention relates to a comb-line high-frequency filter or the like, comprising an elongated casing (1) of an electrically conductive material, conductor rods of an electrically conductive material being arranged in a sequence at predetermined intervals in a substantially integral air cavity within the casing, one end of each conductor rod being short-circuited to the casing and its other end being detached therefrom so that each conductor rod forms with the casing (1) an air-insulated coaxial resonator. In each coaxial resonator, the ratio between the diameters (X, Y) of the casing (1) and the resonator (3) is within the range from about 2.8 to 3.3.

3 Claims, 1 Drawing Sheet

HIGH FREQUENCY COMB-LIKE FILTER

BACKGROUND OF THE INVENTION

The invention relates to a high-frequency comb-line filter, comprising an elongated casing made of an electrically conductive material, conductor rods of an electrically conductive material being arranged in a sequence at predetermined intervals in a substantially integral air cavity within the casing, one end of each conductor rod being short-circuited to the casing and its other end being detached therefrom so that each conductor rod forms with the casing an air-insulated coaxial resonator.

In comb-line filters, the resonators are typically positioned in a sequence one after another so that the inductive and capacitive couplings between the resonators form the couplings between the resonators directly without any separate coupling elements. Therefore, such comb-line filter structures are usually simpler and smaller in structure than conventional filter structures accomplished by separate resonators coupled together, e.g. by separate coils. Comb-line filters can be realized by coaxial resonators, in which case air is used as a medium between the resonators and the electrically conductive casing surrounding the resonators.

FI Patent Application 906215 discloses a comb-line filter in which the medium is air, that is, the filter is air-insulated. In this filter, the resonators consist of electrically conductive conductor rods enclosed in an integral space defined by a single electrically conductive casing. The casing is common to the resonators, forming a coaxial resonator with each resonator.

Today, very stringent requirements are set on the electrical properties of high-frequency filters while increasingly smaller sizes and lower costs of manufacture are also required. In filters accomplished by coaxial resonators, for instance, one aims at an optimal Q factor and the smallest possible losses by using a theoretical optimum value of 3.6, calculated as the ratio between the diameters of the casing and the resonator of the coaxial resonator, and by manufacturing the casing and the resonator of materials having as low losses as possible (materials of high electrical conductivity), such as a copper casing and resonators coated with silver (cf. "Microwave Filters, Impedance Matching Networks, and Coupling Structures", G. Matthaei, L. Young, E.M.T. Jones, Artech House Books, Dedham, MA USA, p. 165–168). However, such materials are relatively expensive, which increases the cost of manufacture for these filters. So one constantly has to compromise between the size, properties and cost of manufacture of the filter.

SUMMARY OF THE INVENTION

The object of the invention is to decrease the size and/or cost of an air-insulated comb-line filter realized with coaxial resonators without impairing the electrical properties.

This is achieved by means of a comb-line high-frequency filter of the type described in the introduction, which according to the invention is characterized in that in each coaxial resonator, the ratio between the diameters of the casing and the conductor rod is within the range about 2.8 to about 3.3.

The invention is based on the inventor's surprising discovery that the theoretical calculatory ratio of 3.6 between the diameters of the casing and the resonator of the coaxial resonator, which has generally been regarded as an optimum value in comb-line filters, does not, in fact, provide the best possible Q factor for the filter, and that considerably better Q factors are achieved with values smaller than this theoretical ratio, ranging approximately from 2.8 to 3.3. This is obviously due to the mutual interference between the resonators in a comb-line type filter. By using a ratio in the range according to the invention, at least the following advantages are achieved:

The electrical properties of air-insulated filters previously realized with the ratio of 3.6 can be improved without increasing the size of the filter or without using better materials.

The electrical properties of air-insulated filters previously realized with the ratio of 3.6 can be achieved by using inferior and less expensive materials.

The electrical properties of air-insulated filters previously realized with the ratio of 3.6 can be achieved with a smaller filter without using better materials.

In other words, the properties, price and size of an air-insulated filter can be influenced in a very simple way by means of the invention.

DESCRIPTION OF THE DRAWING

The invention will now be described in more detail by means of an illustrating embodiment with reference to the drawing, in which.

DETAILED DESCRIPTION

Figure 1:
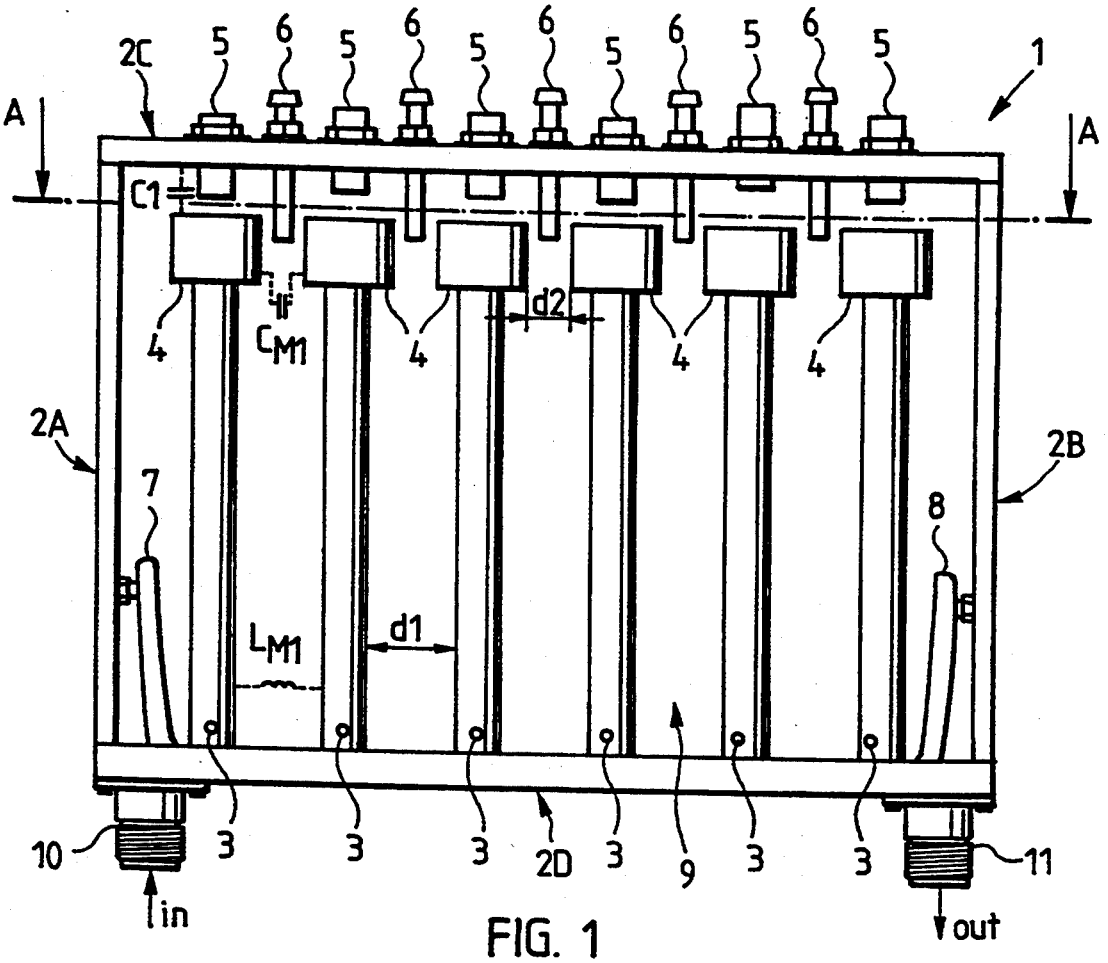
FIG. 1 is a diagrammatic sectional view of the mechanical structure of a high-frequency comb-line filter according to the invention.
Figure 2:
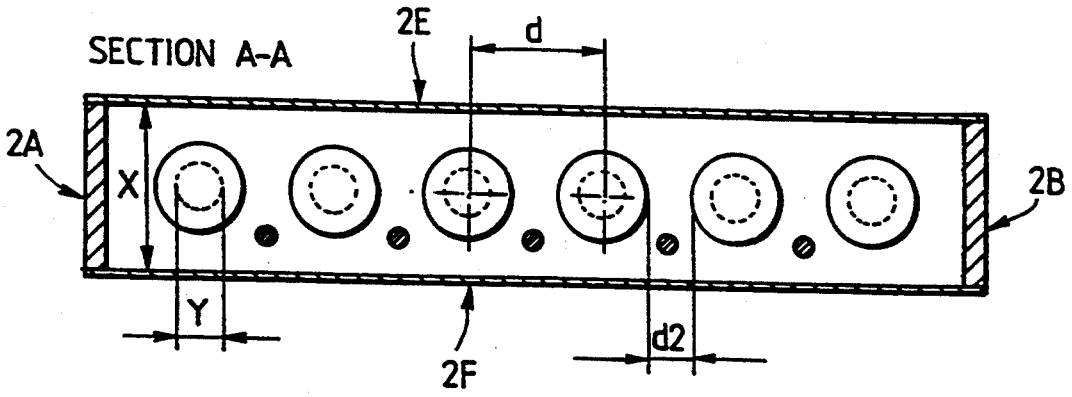
FIG. 2 is a sectional top view of the high-frequency comb-line filter shown in FIG. 1, taken along the line A—A shown in FIG. 1.

Referring now to FIGS. 1 and 2, the high-frequency bandpass filter comprises a rectangular, elongated casing, closed on all sides, and comprising end plates 2A and 2B, a top plate 2C, a bottom plate 2D and side plates 2E and 2F. The casing may be made of an electrically conductive material and/or coated with a conductive material, such as copper or yellow chrome. The plates 2A–2F forming the casing define therebetween an integral cavity 9 extending substantially over the entire length of the casing. Six cylindrical conductor rods 3 are positioned in this cavity 9 in succession at predetermined intervals, each conductor rod being secured and short-circuited at its lower end to the bottom plate 2D of the casing and spaced at its upper end apart from the top plate 2C of the casing, so that the conductor rod 3 forms a coaxial resonator with the casing, in which the rod 3 is the inner conductor or resonator, and the casing is the outer conductor or shell, air being used as a medium. The resonator rods 3 are made of an electrically conductive material or coated with an electrically conductive material, such as copper or silver.

In this way, an open comb-line type air-insulated filter structure is achieved, in which the couplings between the resonators are formed directly by the inductive and/or capacitive couplings between the resonator rods 3, as illustrated by capacitor $C_{M1}$ and coil $L_{M1}$.

In the preferred embodiment shown in FIGS. 1 and 2, each resonator rod 3 is secured at its lower end to the bottom plate 2D of the casing and further comprises a cylindrical knob portion 4 of a larger diameter attached to its upper end, the knob portion being preferably made of copper. The structure of a resonator rod of this kind, comprising a knob portion 4, is described in FI Patent Application 906251. In such a structure, the capacitive coupling or the inductive coupling can be made the predominant coupling type in the coupling between two adjacent coaxial resonators by adjusting the ratio of the distance d1 between the resonator rods of the respective coaxial resonators and the distance d2 between the knobs 4. By varying the type of coupling, the filter responses can be varied.

The resonators 3 may, however, also be realized in a conventional way without the knob 4.

A metal tuning screw 5 is provided in the top plate 2C of the casing 1, extending into the inner cavity 9 of the casing above the resonator rod 3. The distance of the lower end of the tuning screw 5 from the upper end of the resonator rod 3 determines the value of the earth capacitance C1 between the casing and the resonator rod 3, the earth capacitance being illustrated by capacitor C1, drawn in broken lines. The earth capacitance and thereby the resonance frequency of an individual resonator can be adjusted by means of the tuning screw 5. In the top plate 2C of the casing 1, in the area between two adjacent conductor rods, there is further provided a metal tuning screw 6 extending into the casing. This tuning screw enables the fine adjustment of the capacitance between the knobs 4 of two adjacent conductor rods and thereby the fine adjustment of the coupling between adjacent resonators. In the embodiment of FIG. 1, the filter input is formed by a conductor loop 7 introduced into the casing 1 through an inlet 10 provided in the bottom plate 2D, the end of the conductor loop within the casing being connected to the bottom plate 2D. The conductor loop 7 is positioned in a space between one end plate 2A of the casing and the resonator rod 3 closest to it. The filter output is correspondingly formed by a conductor loop 8 introduced into a space between the opposite end plate 2B and the resonator rod closest to it through an inlet 11, one end of the conductor loop 8 being connected to the bottom plate 2D. The conductor loops 7 and 8 form coils which are inductively connected to the closest resonator rod 3.

In accordance with the invention, in each coaxial resonator of the filter, the ratio between the diameter X of the outer conductor or casing and the diameter Y of the resonator is approximately within the range 2.8 to 3.3. In the rectangular casing of a comb-line filter, the diameter X represents the dimension of the casing in the direction of its width at the resonator 3, as shown in FIG. 2 (the figure being not drawn to scale).

The advantages obtained with the invention are illustrated by the following example. A filter of the type shown in FIGS. 1 and 2 was first realized with a conventional X/Y ratio of 3.6 (X=36 mm and Y=10 mm), in which case it was necessary to use an aluminum casing coated with copper and copper rod resonators coated with silver to obtain the required electrical properties. The same filter was then realized with the X/Y ratio according to the invention, i.e. 3.0 (X=36 mm, Y=12 mm), and the same electrical properties were now obtained by using a casing coated with yellow chrome and resonators coated with copper. In this way the use of silver and the coating of the casing with copper could be avoided completely. Instead, the casing could be coated with the less expensive yellow chrome, such coating also being easier to perform.

The figures and the description relating thereto are only intended to illustrate the present invention. In its details, the filter according to the invention may vary within the scope of the attached claims.

I claim:

1. A high-frequency comb-line filter comprising:

an outer conductor in form of an elongated casing made of an electrically conductive material and having a width, said casing defining an air cavity within said housing, a plurality of inner conductors in form of conductor rods made of an electrically conductive material and each having a diameter, said conductor rods being arranged in line and spaced apart each other within said air cavity, each of said conductor rod being short-circuited to the casing at one end so that each conductor rod forms with the housing an air-insulated coaxial resonator, the ratio of said diameter of each of said conductor rods to said width of said casing being within a range from about 2.8 to 3.3.

2. The high-frequency comb-line filter according to claim 1, wherein:

said casing is coated with yellow chrome and the conductor rods (3) are made of copper, and wherein said ratio of said diameter of each of said conductor rods to said width of said casing is about 3.0.

3. The high-frequency comb-line filter according to claim 1, wherein:

said casing is coated with yellow chrome and the conductor rods are coated with copper, and wherein said ratio of said diameter of each of said conductor rods to said width of said casing is about 3.0.

* * * * *